US005999089A

United States Patent [19]

Carlson

[11] Patent Number: 5,999,089

[45] Date of Patent: Dec. 7, 1999

[54] ALARM SYSTEM

[76] Inventor: Lance K. Carlson, 509 Logan, Helena, Mich. 59601

[21] Appl. No.: 08/855,339

[22] Filed: May 13, 1997

[51] Int. Cl.[6] ..... G08B 1/00; G10K 11/00

[52] U.S. Cl. ..... 340/328; 340/628; 340/531; 340/566; 367/197

[58] Field of Search ..... 340/328, 539, 340/628, 531, 566; 367/197–199

[56] References Cited

U.S. PATENT DOCUMENTS

| | | | |
|---|---|---|---|
| 3,936,822 | 2/1976 | Hirshberg | 340/420 |
| 4,001,805 | 1/1977 | Golke | 340/280 |
| 4,417,235 | 11/1983 | Del Grande | 340/531 |
| 4,450,436 | 5/1984 | Massa | 340/531 |
| 4,617,555 | 10/1986 | Sheiman | 340/531 |
| 5,012,223 | 4/1991 | Griebell et al. | 340/531 |
| 5,172,093 | 12/1992 | Nose et al. | 340/426 |
| 5,442,336 | 8/1995 | Murphy et al. | 340/628 |

*Primary Examiner*—Donnie L. Crosland
*Attorney, Agent, or Firm*—Joseph N. Breaux

[57] ABSTRACT

An alarm system that includes a number of alarm detecting devices wherein each alarm detecting device includes an alarm condition detecting circuit, a secondary alarm activation circuit, and an audible alarm output circuit including an audio oscillator and a speaker; the audible alarm output circuit being responsive to a detecting circuit control output generated by the alarm condition detecting circuit and to a secondary triggering output signal generated by the secondary alarm activation circuit; the secondary alarm activation circuit including a microphone having a microphone output signal, an amplifier circuit in connection with the microphone output signal and generating an amplified output signal, a filter circuit having a filter input in connection with the amplifier output signal generating a filtered output signal in a first predetermined frequency range; a filter signal integrator having an integrator input in connection with the filtered output signal for integrating the filtered signal output and generating an integrated output signal; a reference signal generator having a reference signal output; a comparator circuit having a reference signal input in connection with the reference signal output and a compared signal input in connection with the integrated output signal, and generating the secondary alarm triggering output signal when the compared signal input exceeds the reference signal input.

1 Claim, 2 Drawing Sheets

ALARM SYSTEM

TECHNICAL FIELD

The present invention relates to alarm devices and more particularly to a battery operated alarm device, such as a carbon monoxide or smoke detector alarm, that includes an alarm condition detecting circuit, a secondary alarm activation circuit, and an audible alarm output circuit including an audio oscillator and a speaker; the audible alarm output circuit being responsive to a detecting circuit control output generated by the alarm condition detecting circuit and to a secondary triggering output signal generated by the secondary alarm activation circuit; the secondary alarm activation circuit including a microphone having a microphone output signal, an amplifier circuit in connection with the microphone output signal and generating an amplified output signal, a filter circuit having a filter input in connection with the amplifier output signal generating a filtered output signal in a first predetermined frequency range; a filter signal integrator having an integrator input in connection with the filtered output signal for integrating the filtered signal output and generating an integrated output signal; a reference signal generator having a reference signal output; a comparator circuit having a reference signal input in connection with the reference signal output and a compared signal input in connection with the integrated output signal, and generating the secondary alarm triggering output signal when the compared signal input exceeds the reference signal input.

BACKGROUND OF THE INVENTION

Battery powered alarm detecting devices, such as homeowner installed smoke and carbon monoxide detectors, typically provide an audible output in response to detecting the desired alarm condition. Although these alarm detecting devices provide valuable warnings to occupants of the room within which they are installed, the output level of the audible alarm is often insufficient to alert sleeping individuals in another portion of the home or building when the alarm condition is first detected. Because each of the detecting devices operates in isolation from the other detecting devices installed within the home or building an alarm condition can be detected by one of the alarm detecting devices while the other alarm detecting device provide no warning. It would be a benefit, therefore, to have an alarm system that was easily installed by a homeowner and that included a number of alarm detecting devices each including a secondary triggering mechanism that detected activation of the other alarm detecting devices installed within the home or building. Because, each home or building may have different transmitting characteristics between the detecting devices it would also be desirable to have an alarm system that included a number of alarm detecting devices each including a secondary triggering mechanism that detected activation of the other alarm detecting devices installed within the home or building and that could be tuned for peak performance during installation.

SUMMARY OF THE INVENTION

It is thus an object of the invention to provide an alarm system that includes a number of alarm detecting devices wherein each of the alarm detecting devices includes a secondary triggering mechanism that detects activation of the other alarm detecting devices installed within the home or building and provides an audible alarm.

It is a further object of the invention to provide an alarm system that is easily installed and that includes a number of alarm detecting devices wherein each of the alarm detecting devices includes a secondary triggering mechanism that detects activation of the other alarm detecting devices installed within the home or building and provides an audible alarm.

It is a still further object of the invention to provide an alarm system that includes a number of alarm detecting devices wherein each of the alarm detecting devices includes a secondary triggering mechanism that detects activation of the other alarm detecting devices installed within the home or building and provides an audible alarm and wherein each of the secondary triggering mechanisms can be tuned for peak performance during installation.

It is a still further object of the invention to provide an alarm system that includes a number of alarm detecting devices wherein each alarm detecting device includes an alarm condition detecting circuit, a secondary alarm activation circuit, and an audible alarm output circuit including an audio oscillator and a speaker; the audible alarm output circuit being responsive to a detecting circuit control output generated by the alarm condition detecting circuit and to a secondary triggering output signal generated by the secondary alarm activation circuit; the secondary alarm activation circuit including a microphone having a microphone output signal, an amplifier circuit in connection with the microphone output signal and generating an amplified output signal, a filter circuit having a filter input in connection with the amplifier output signal generating a filtered output signal in a first predetermined frequency range; a filter signal integrator having an integrator input in connection with the filtered output signal for integrating the filtered signal output and generating an integrated output signal; a reference signal generator having a reference signal output; a comparator circuit having a reference signal input in connection with the reference signal output and a compared signal input in connection with the integrated output signal, and generating the secondary alarm triggering output signal when the compared signal input exceeds the reference signal input.

It is a still further object of the invention to provide an alarm system that accomplishes some or all of the above objects in combination.

Accordingly, an alarm system is provided. The alarm system includes a number of alarm detecting devices wherein each alarm detecting device includes an alarm condition detecting circuit, a secondary alarm activation circuit, and an audible alarm output circuit including an audio oscillator and a speaker; the audible alarm output circuit being responsive to a detecting circuit control output generated by the alarm condition detecting circuit and to a secondary triggering output signal generated by the secondary alarm activation circuit; the secondary alarm activation circuit including a microphone having a microphone output signal, an amplifier circuit in connection with the microphone output signal and generating an amplified output signal, a filter circuit having a filter input in connection with the amplifier output signal generating a filtered output signal in a first predetermined frequency range; a filter signal integrator having an integrator input in connection with the filtered output signal for integrating the filtered signal output and generating an integrated output signal; a reference signal generator having a reference signal output; a comparator circuit having a reference signal input in connection with the reference signal output and a compared signal input in connection with the integrated output signal, and generating the secondary alarm triggering output signal when the compared signal input exceeds the reference signal input. In a preferred embodiment, the filter circuit is tunable with a tuning mechanism to allow a user to select the first predetermined frequency range.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENTS

Figure 1:
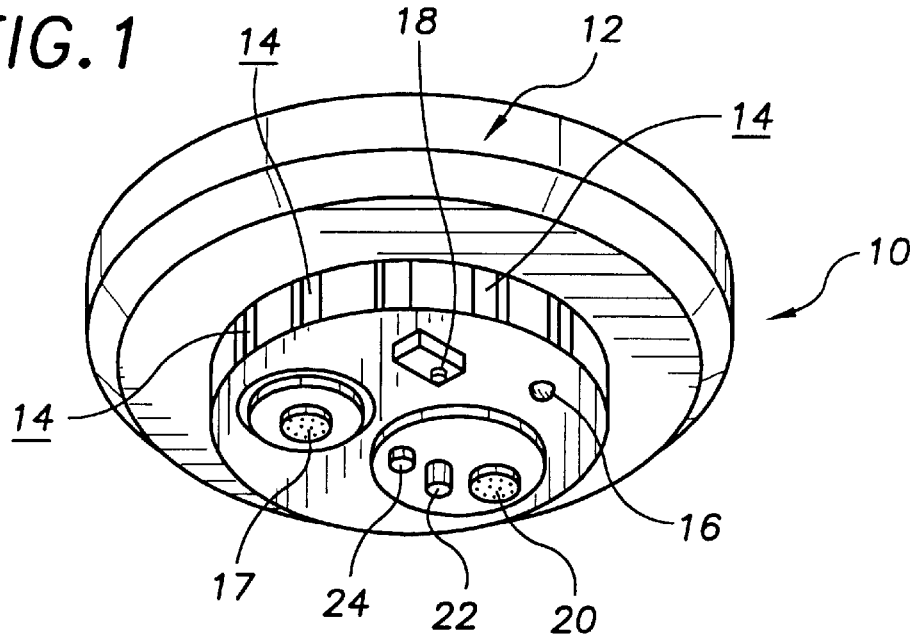
FIG. 1 is a perspective view of the exterior of an exemplary embodiment of one of the alarm devices the alarm system of the present invention showing the alarm device housing, the smoke sensing element inlet apertures, the battery power LED, the alarm reset switch, the microphone pickup, the filter tuning knob, and the temporary disable switch.

FIG. 1 shows an exemplary embodiment of one of the three identical smoke detecting alarm devices of the alarm system of the present invention, generally designated by the numeral 10. Alarm device 10 includes a molded plastic housing, generally designated 12, having a number of smoke sensing element inlet apertures 14. Alarm device 10 has a battery power level indicator LED 16 that is illuminated when the battery has sufficient power to operate alarm device 10. The exterior of alarm housing 12 has a speaker cover 17, an alarm reset switch 18, a microphone pickup 20, a filter tuning knob 22, and a temporary disable switch 24.

Figure 2:
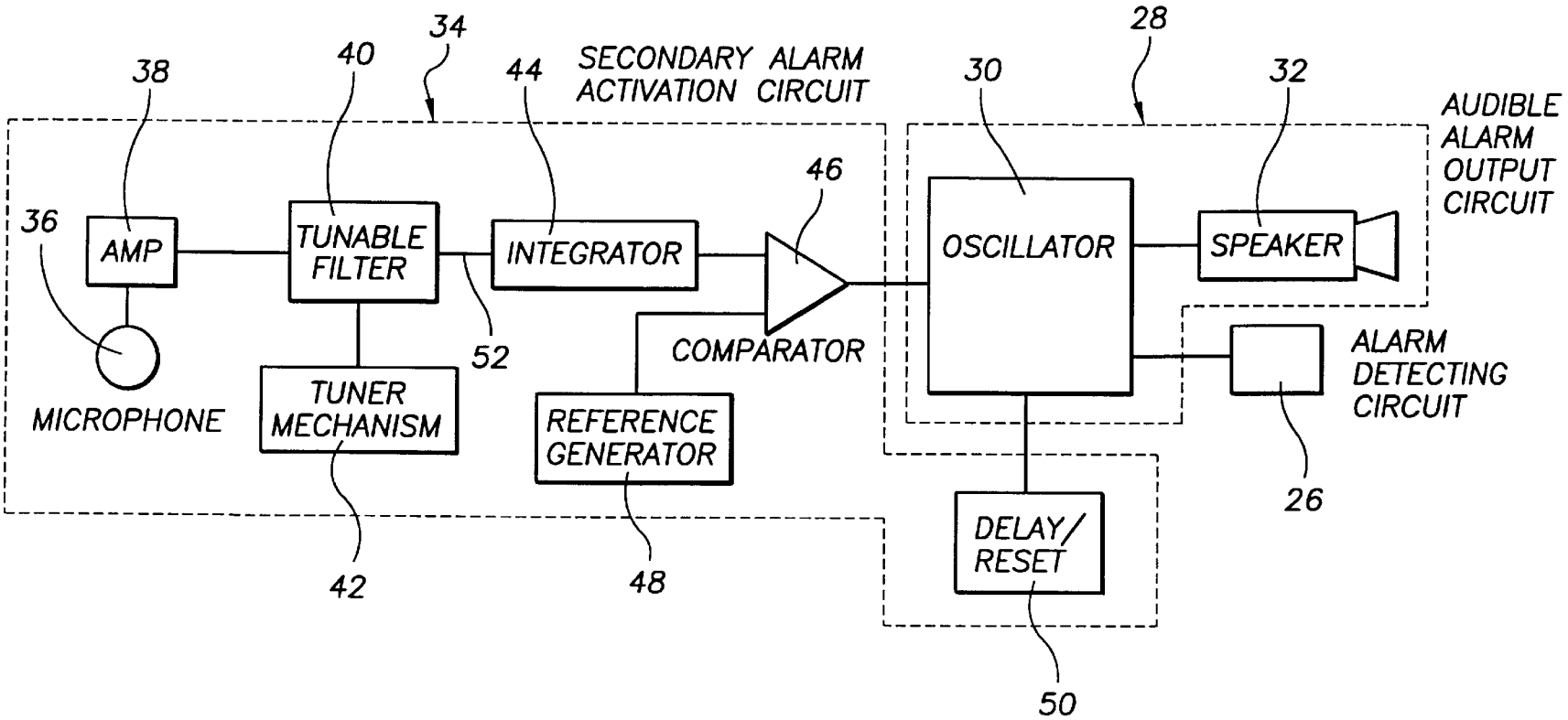
FIG. 2 is a schematic diagram of the alarm device of FIG. 1 showing the conventional alarm condition detecting circuit; the audible alarm output circuit including the audio oscillator and the speaker; and the secondary alarm activation circuit including the microphone, the amplifier circuit, the tunable filter circuit, the filter tuning mechanism, the filter signal integrator, the comparator circuit, the reference voltage generating circuit, and the device delay/reset circuit.

With reference to FIG. 2, alarm housing 12 houses the operational circuitry required for operation of alarm device 10 including a conventional smoke alarm condition detecting circuit 26; an audible alarm output circuit, generally designated 28, including an audio oscillator 30 and a speaker 32; and a secondary alarm activation circuit, generally designated 34, including a microphone 36, a amplifier circuit 38, a tunable filter circuit 40, a filter tuning mechanism 42, a filter signal integrator 44, a comparator circuit 46, a reference voltage generating circuit 48, and a device delay/reset circuit 50.

Audible alarm output circuit 28 is a conventional oscillator driven speaker that responds to control outputs generated by either the alarm condition detecting circuit 26 or the secondary alarm activation circuit 34 by outputting an audible alarm from speaker 32 at a frequency level over fifteen thousand hertz. In this embodiment, alarm condition detecting circuit 26 is a conventional battery powered smoke detecting circuit well known in the art.

Figure 3:
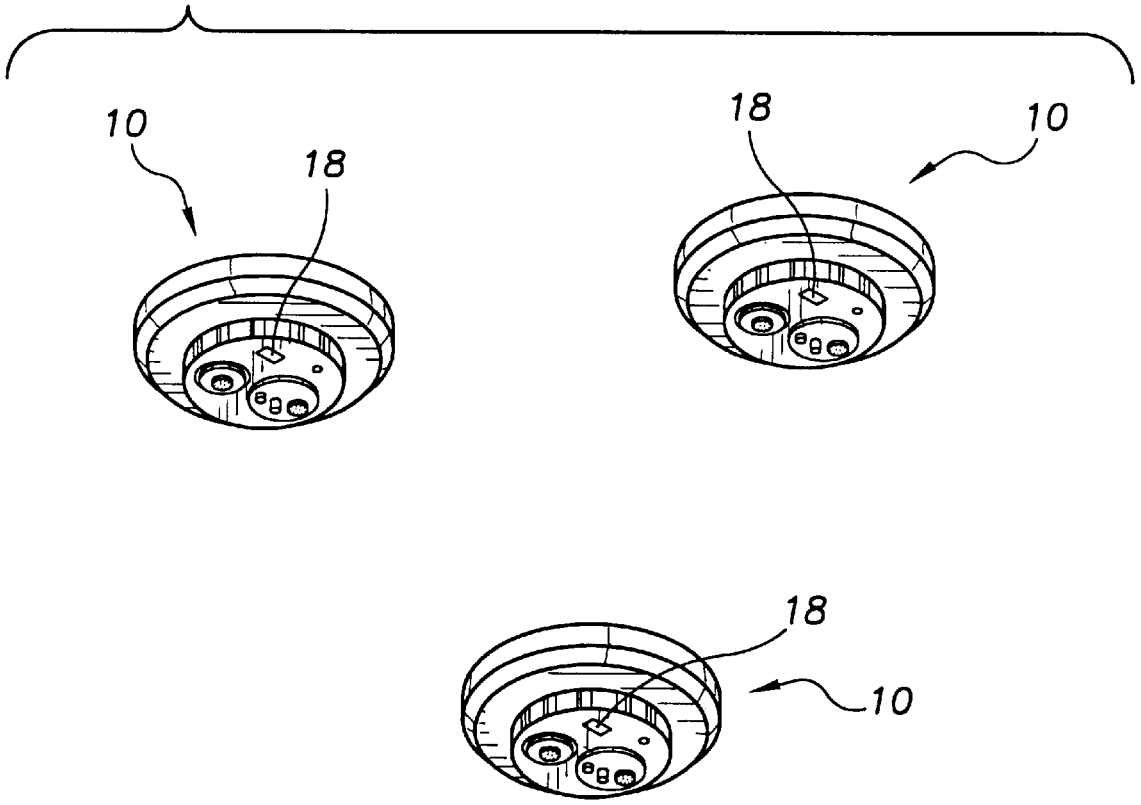
FIG. 3 is a perspective view showing three of the alarm devices of FIG. 1 in an exemplary installation.

Secondary activation circuit operates to detect the audible alarm output from speaker 32 by picking up all ambient sounds with microphone 36, amplifying the microphone output signal with amplifier circuit 38 and then filtering the amplified output signal from the amplifier with tunable filter circuit 40 by removing all amplified components of the amplified output signal below fourteen thousand hertz. The filtered output signal thus generated is then rectified within tunable filter circuit 48 and fed into the integrator input 52 of integrator circuit 44. Integrator circuit 44 integrates the filtered output signal to produce an integrated output signal whose output level is proportional to the length of time and intensity of all the audible noise picked up by microphone 36 above a frequency range greater than fourteen thousand hertz. Because the audible alarm output from speaker 32 is at a frequency level over fifteen thousand hertz, a continuous audible alarm output from speaker 32 for a period of thirty seconds or more is sufficient to cause the integrated output signal from integrator circuit 44 to exceed the value of the reference signal output generated by reference voltage generating circuit 48. When integrated output signal from integrator circuit 44 exceeds the value of the reference signal output generated by reference voltage generating circuit 48 comparator circuit 46 generates the secondary alarm triggering output signal causing audible alarm output circuit 28 to output an audible alarm from speaker 32. The output from speaker 32 is sufficient to keep speaker 32 operating continuously until device delay/reset circuit 50 is activated by depressing temporary disable switch 24 (FIG. 1). Delay/reset circuit 50 deactivates the audible output from speaker 32 for a preset period, in this embodiment four minutes, to allow all of the smoke detecting alarm devices 10 (FIG. 3) to be reset by depressing alarm reset switch 18 (FIG. 1). Without a delay/reset circuit 50, operation of speaker 32 of only one smoke detecting alarm device 10 would keep reactivating all of the smoke detecting alarm devices 10.

It can be seen from the preceding description that an alarm system has been provided that includes a number of alarm detecting devices wherein each of the alarm detecting devices includes a secondary triggering mechanism that detects activation of the other alarm detecting devices installed within the home or building and provides an audible alarm; that is easily installed; that includes a number of alarm detecting devices wherein each of the alarm detecting devices includes a tunable secondary triggering mechanism that detects activation of the other alarm detecting devices installed within the home or building; that includes a number of alarm detecting devices wherein each alarm detecting device includes an alarm condition detecting circuit, a secondary alarm activation circuit, and an audible alarm output circuit including an audio oscillator and a speaker; the audible alarm output circuit being responsive to a detecting circuit control output generated by the alarm condition detecting circuit and to a secondary triggering output signal generated by the secondary alarm activation circuit; the secondary alarm activation circuit including a microphone having a microphone output signal, an amplifier circuit in connection with the microphone output signal and generating an amplified output signal, a filter circuit having a filter input in connection with the amplifier output signal generating a filtered output signal in a first predetermined frequency range; a filter signal integrator having an integrator input in connection with the filtered output signal for integrating the filtered signal output and generating an integrated output signal; a reference signal generator having a reference signal output; a comparator circuit having a reference signal input in connection with the reference signal output and a compared signal input in connection with the integrated output signal, and generating the secondary alarm triggering output signal when the compared signal input exceeds the reference signal input.

It is noted that the embodiment of the alarm system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An alarm system comprising:

at least two alarm detecting devices, each alarm detecting device comprising:

an alarm condition detecting circuit, a secondary alarm activation circuit, and an audible alarm output circuit including an audio oscillator and a speaker;

said audible alarm output circuit being responsive to a detecting circuit control output generated by said alarm condition detecting circuit and to a secondary triggering output signal generated by said secondary alarm activation. circuit;

said secondary alarm activation circuit including:

a microphone having a microphone output signal, an amplifier circuit in connection with said microphone output signal and generating an amplified output signal, a tunable filter circuit having a filter input in connection with said amplifier output signal, said tunable filter circuit generating a filtered output signal in a first predetermined frequency range, said tunable filter circuit including a tuning mechanism tunable by a user to set a desired said first frequency range;

a filter signal integrator having an integrator input in connection with said filtered output signal for integrating said filtered signal output and generating an integrated output signal;

a reference signal generator having a reference signal output;

a comparator circuit having a reference signal input in connection with said reference signal output and a compared signal input in connection with said integrated output signal, and generating said secondary alarm triggering output signal when said compared signal input exceeds said reference signal input.

* * * * *